US007260915B2

(12) United States Patent
Cronenberg et al.

(10) Patent No.: US 7,260,915 B2
(45) Date of Patent: Aug. 28, 2007

(54) DOOR SEAL DEVICE

(75) Inventors: Carl-Julius Cronenberg, Arnsberg (DE); Jenö Faflek, Arnsberg (DE)

(73) Assignee: Firma F. Athmer, Arnsberg (DE)

( * ) Notice: Subject to any disclaimer, the term of this patent is extended or adjusted under 35 U.S.C. 154(b) by 462 days.

(21) Appl. No.: 10/820,884

(22) Filed: Apr. 9, 2004

(65) Prior Publication Data

US 2004/0205999 A1 Oct. 21, 2004

(30) Foreign Application Priority Data

Apr. 15, 2003 (DE) ..... 203 06 091 U
Nov. 12, 2003 (EP) ..... 03026022

(51) Int. Cl.
*E06B 7/20* (2006.01)

(52) U.S. Cl. ..... 49/308; 49/307; 49/306

(58) Field of Classification Search ..... 49/303, 49/306, 307, 308, 309, 310
See application file for complete search history.

(56) References Cited

U.S. PATENT DOCUMENTS

| | | | | | |
|---|---|---|---|---|---|
| 1,111,737 | A | * | 9/1914 | Coonradt | 49/307 |
| 1,478,974 | A | * | 12/1923 | Marcotte | 49/310 |
| 1,709,419 | A | * | 4/1929 | Sward | 49/308 |
| 2,066,188 | A | * | 12/1936 | Frank | 49/307 |
| 4,089,136 | A | * | 5/1978 | Lapinski et al. | 49/308 |
| 4,519,165 | A | * | 5/1985 | Cronenberg et al. | 49/307 |
| 4,805,345 | A | * | 2/1989 | Ohi | 49/308 |
| 6,082,047 | A | * | 7/2000 | Comaglio et al. | 49/308 |

FOREIGN PATENT DOCUMENTS

| | | |
|---|---|---|
| DE | 24 58 496 | 6/1976 |
| DE | 3935790 | 2/1991 |
| EP | 0 916 802 | 5/1999 |
| FR | 884694 | 8/1943 |
| JP | 10068278 | 3/1998 |

* cited by examiner

*Primary Examiner*—Jerry Redman
(74) *Attorney, Agent, or Firm*—Hoffman, Wasson & Gitler, P.C.

(57) ABSTRACT

The present invention relates to a method for installing and adjusting a door seal device on a door leaf for the purpose of sealing off a lower door gap, the door seal device having at least one trigger on the hinge side and/or lock side and the door seal device initially being installed in such a way that the trigger has a greater projection than necessary and the door is then closed, an axial displacement of the trigger with respect to a transmission element connected to the latter occurring as a result of a floor contact pressure of a seal profile that exceeds a reference value, which leads to self-adjustment of the extent of the projection of the trigger, and the trigger then remaining in this adjusted position when the door is reopened.

20 Claims, 4 Drawing Sheets

11
9
13
13
11
9
13
11a 11
13
9
11
9
13
8

11
14
9
14
9
11

11
15
9

11
16
17
13

16
13
17
11

16
17
13
11

DOOR SEAL DEVICE

BACKGROUND OF THE INVENTION

The present invention relates to a method for installing and adjusting a door seal device on a door leaf for the purpose of sealing off a lower door gap, the door seal device having at least one trigger on the hinge side and/or lock side and the door seal device initially being installed in such a way that the trigger has a greater projection than necessary and the door is then closed, an axial displacement of the trigger with respect to a transmission element connected to the latter occurring as a result of a floor contact pressure of a seal profile that exceeds a reference value.

Door seal devices of the aforementioned type are installed in a door leaf by a carpenter or fitter, for example let into a groove. During installation, an adjustment must be made which ensures that the trigger projecting on the hinge side or lock side projects to such an extent that a sufficient axial displacement of the trigger takes place when the door is closed, ensuring the desired displacement of the seal profile which is lowered during closing. During this adjustment, various parameters have to be considered. Firstly, there is the matter of the required sealing height, that is to say the height of the lower gap between the door leaf and the floor. Furthermore, what is known as the rabbet clearance plays a part, that is the gap between the door leaf and the door frame in the rabbet area when the door is closed. Finally, there is the matter of what floor pressure is respectively desired for the sealing profile.

This floor pressure should not be too high, in order that the seal profile is not deformed too severely by the floor contact pressure when the door is closed. On the other hand, there must be at least a floor pressure such that the gap with respect to the floor is sealed off effectively. Since, in particular, the trigger on the hinge side ensures that the door seal is already lowered to a certain extent at a time before the door has reached its closed position, thought must also be given to the fact that the seal profile drags over the floor as a result of the floor pressure. An excessively high floor contact pressure therefore leads to wear of or damage to the seal device. The adjustment of the required floor pressure of the sealing profile is carried out by the installer via the corresponding position of the trigger. In some known seal devices, a tool is needed for this purpose, or the trigger fitting is constructed in a complicated manner with a spring to be pulled out, so that it is relatively time-consuming until the correct adjustment has been found. This is made more difficult in particular by the fact that the installer usually has to find the correct adjustment by trial and error, so that he possibly has to change the trigger position many times and, for this purpose, in each case has to open and close the door in order to monitor the result of the respective adjustment. EP-A-0841457 describes a door seal device of the generic type mentioned at the beginning in which the projection of the trigger is regulated by a threaded bolt used as a transmission element being screwed to a greater or lesser extent into an internal thread belonging to the trigger. In other known door seal devices, the adjustment is made by rotating the triggering element; in particular in the case of an angular triggering element on the lock side, it is frequently the case that a complete rotation of the trigger always has to be performed, so that no very fine adjustment is possible.

Furthermore, thought must be given to the fact that, depending on the construction of the door seal device and the formation of the transmission elements which convert the axial displacement travel of the trigger into a lowering movement of the seal, a relatively small change in the position of the trigger can lead to a much higher change in the floor lowering displacement of the seal. In particular, it is possible that the displacement of the seal profile is a multiple of the displacement of the trigger. For these reasons, it is particularly important that the most exact position of the trigger is chosen during the adjustment before the door seal is put into use.

FR 884 694 describes a door seal device of the generic type mentioned at the beginning. In order to avoid an excessively high floor contact pressure of the seal building up, the triggering mechanism is formed in two parts with a hollow rod which is connected to a lowering mechanism for a sealing bar. Within this hollow rod there is a further rod, which can be displaced axially over a certain distance in the first-named rod. In this case, a spring mechanism is provided, which has a spiral spring, which has two stops as abutments. As a result, the inner rod, which is connected directly to the projecting trigger, can slide within the outer rod when the floor contact pressure of the seal is too high. In this known door seal device, although compensation which avoids an excessively high floor contact pressure of the seal profile is produced during lowering by the spring, this is not a self-adjustment, since when the door is opened again, the trigger assumes its original position again. Therefore, if, in the case of this known door seal device, the trigger projects too far, during each closing operation, too high a pressure on the seal profile meeting the floor occurs, which leads to a dragging movement of the seal profile on the floor. Although this is then compensated for by the aforementioned spring during further closing the door, during each door closing operation, initially the excessively high loading of the seal profile occurs, and also a dragging movement on the floor. There is no optimum adjustment of the trigger, and high wear of the seal profile and of the mechanism is therefore to be expected.

An object of the present invention is to provide a method for installing and adjusting a door seal device of the generic type mentioned at the beginning which avoids wear on seal profile and mechanism, is easy to install and permits simple achievement of the optimum adjustment of the trigger in each case with regard to the floor contact pressure of the seal profile in accordance with the respective constructional conditions. Furthermore, it is an object of the present invention to provide a seal device, which can be used in a method of the aforementioned type.

This object is achieved by a method according to the invention for installing and adjusting a door seal device.

SUMMARY OF THE INVENTION

According to the invention, self-adjustment of the trigger is provided, as a result of which the previously complicated search for the correct position of the trigger and testing whether the desired floor pressure of the seal profile is present are rendered superfluous. The self-adjustment is achieved, according to the invention, in that when a floor contact pressure of the seal profile exceeding a reference value occurs, the trigger is displaced axially with respect to a transmission element connected to the trigger. The aforementioned transmission element is part of the mechanism for transmitting the axial displacement to a vertical displacement movement of the seal profile. According to a preferred design variant of the invention, the transmission element comprises a rod, in particular a threaded rod, and the trigger is constructed in such a way that, when the desired floor contact pressure of the seal profile is exceeded, it jumps over at least one thread of the threaded rod and, as a result, adjusts itself.

The method according to the invention for installing and adjusting the door seal device has a considerably greater benefit for the user as compared with the conventional procedure. The previously complicated and time-consuming adjustment of the seal following installation, in which, as a rule, multiple correction of the adjustment initially made was necessary, is dispensed with. The door seal device is, for example, supplied by the manufacturer in a delivered state in which the trigger has an extent of the projection, which is greater than the extent necessary in the application. By means of the mechanism for self-adjustment according to the invention, the first time the door is closed, the self-adjustment of the trigger is then achieved, in which the latter is displaced axially with respect to a transmission element connected thereto to such an extent that the floor contact pressure of the seal profile is minimized and the result is an optimum adjustment of the seal device. This optimum adjustment is provided when the floor joint is tight but no pressure is exerted on the floor by the seal profile. With this adjustment, when the door is closed, the smallest dragging movement of the seal profile on the floor is obtained. As distinct from the prior art, the adjustment of the position of the trigger takes place automatically and permanently. This means that, during the renewed opening of the door, the trigger remains in the adjusted and thus optimized position, so that, when the door is closed again, no more overloading of the seal profile and of the mechanism occurs. The extent of the projection of the trigger is therefore reduced automatically according to the invention and is maintained during all subsequent door-closing operations. However, if the conditions change as a result of external conditions, for example because the door sinks, as a result of which the floor clearance of the door seal becomes smaller, the pressure on the trigger increases. In the solution according to the invention, this then leads to automatic readjustment, that is renewed displacement of the axial position of the trigger, as a result of which an optimized adjusted position of the trigger matched to the individual force conditions is then again achieved. This projection position of the trigger, which has arisen as a result of readjustment, is also "permanent", which, within the context of the present invention, is understood to mean that the trigger remains in the adjusted position even when the door is reopened and does not move back into an earlier position before the adjustment. During all the subsequent closing operations of the door, the trigger therefore covers a shorter displacement travel than before the adjustment.

However, within the scope of the present invention, numerous variants are possible in order to achieve the aforementioned self-adjustment of the trigger. For example, the trigger can be provided with means, which permit occasional radial expansion and elastic reverse deformation of the trigger. By means of a thrust force acting in the axial direction, which is transmitted from the lowering mechanism to the trigger, the latter is expanded and, as a result, is displaced with respect to the transmission element connected to the trigger. As a result of the elastic reverse deformation ability of the trigger, the original state can be produced again, so that it is also possible to perform such a self-adjustment of the trigger repeatedly. This is expedient, for example, when subsequent changes in the environment of the installed door seal are made, for example when a new floor covering is laid, so that the lower door gap is changed. There can also be an installation error present, for example, which makes it necessary to remove the door seal device again and install it in another door. In this case, according to the invention, renewed self-adjustment of the trigger can likewise be carried out following the renewed installation of the door seal device. During the installation of the door seal device, according to the invention the procedure can be such that, firstly, the trigger is brought into a position in which too high a floor pressure of the seal profile is to be expected. The first time the door is closed, the self-adjustment of the trigger is then carried out, by means of which the latter is moved further inward into the correct position. In this way, it is possible to prevent the situation where, even before the adjustment, a position of the trigger is chosen in which the latter is located too far in, so that self-adjustment would then no longer be possible, since the trigger can naturally adjust itself only in one direction. The aforementioned radial expansion of the trigger during the self-adjustment operation can be achieved, for example, by means of a slit in the wall of the trigger. One possible alternative to a trigger, which jumps over a thread during the self-adjustment, consists, for example, in a plurality of elastic elements provided in an axially mutually offset arrangement being introduced into a bore in the trigger, which accommodates a transmission element. As an alternative to this, the trigger, for example, can be provided in a bore with a rubber thread, at least in some portions, which achieves a similar effect since, when a thrust force occurs, the transmission element slips in the rubber thread until the adjusted position is reached.

It is also possible for the ability of the trigger to be expanded radially to be formed in a variable manner, for example by providing a slot in the trigger, which runs in the longitudinal direction, and holding means which, for example, are pushed over the trigger, it being possible for the trigger to expand radially to a greater or lesser extent depending on the position of these holding means. As a result of this ability to be expanded radially to different extents, the trigger gives way to a greater or lesser extent in the axial direction during the self-adjustment. As a result, it is therefore possible from the start to choose a different reference value of the floor contact pressure of the seal profile. The aforementioned holding means can, for example, be annular, for example use can be made of a rubber ring or spring ring which is pushed onto the trigger which, in this case, is a part which is approximately cylindrical on the outside. However, the trigger can also have a polygonal outline. For instance, it is also possible to provide grooves or profiling or fluting on the circumference of the trigger, which defines the respective axial displacement position of the aforementioned holding means.

Instead of a trigger with an internal thread, according to an alternative solution, a deformation element can be introduced into a bore in the trigger and, when the reference value of the floor contact pressure of the seal is exceeded, is deformed by a thrust force exerted by the transmission element on this deformation element. The axial extent of the deformation element in the bore is therefore preferably reduced, this preferably being done without reverse deformation, that is to say the deformation element cannot be deformed elastically, since the trigger must maintain the appropriate position following the adjustment. For such a deformation element of which the compressive behavior is defined by the design, a folded metal sheet or the like or a hard foam or the like, for example, is suitable.

Another possible alternative variant of the solution according to the invention provides for a transmission element, which is part of the lowering mechanism of the seal to be accommodated with a press fit in a bore in the trigger.

During the self-adjustment, this transmission element is pushed deeper into the bore, as a result of which the surface proportion in the press fit and thus the opposing pressure are increased until the appropriate position of the trigger is reached.

It is also possible to provide multiple self-adjustment in the region of the trigger and/or further parts of the triggering mechanism located in the interior of the housing of the door seal device. For example, door seal devices are known, as described in DE 34 27 938 A1, which use a plurality of spring packs in the triggering mechanism, so that there is then a plurality of parts in which self-adjustment is carried out in a similar way to that described previously for the trigger. In this case, therefore, the self-adjustment is not carried out or not just carried out on the trigger projecting on the outside on the door leaf but on further parts, which are located in the interior of the housing. This procedure is recommended in particular in the case of wider doors with correspondingly long door seal housings, in which use is frequently made of a plurality of spring packs in order to achieve uniform lowering over the length of the door seal.

According to one development of the invention, provision can be made that, in addition to the self-adjustment, manually adjustable fine adjustment of the trigger is also possible. This is expedient, for example, when the self-adjustment is carried out in steps which are still too coarse, for example by jumping over individual threads, so that still more accurate adjustment of the trigger can be carried out manually, which permits intermediate positions between the individual positions of the self-adjustment. In this case, thought should be given to the fact that, as necessitated by the construction, a change in the axial adjustment of the trigger by one length unit can make up a multiple of change on the displacement of the seal device, so that very fine adjustment is practical. However, self-adjustment can also be carried out in such a way that a finely stepped displacement of the trigger becomes possible.

BRIEF DESCRIPTION OF THE DRAWINGS

In the following text, the present invention will be described in more detail using exemplary environments with reference to the appended drawings, in which.

DETAILED DESCRIPTION OF THE INVENTION

Figure 1A:
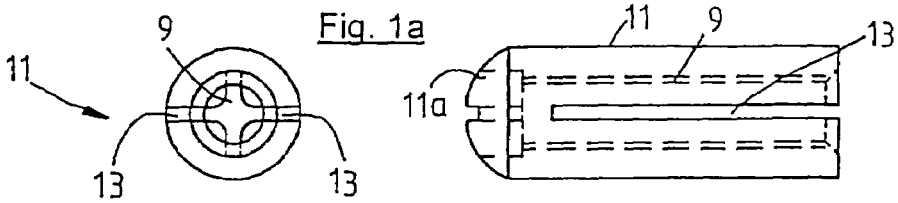
FIG. 1*a* shows a schematically simplified side view and front view of a trigger according to the invention for the hinge side of a door leaf.
Figure 7A:
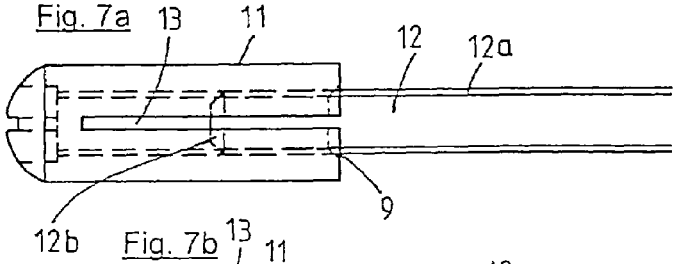
FIG. 7*a* shows a side view of a trigger according to a further alternative variant of the invention.
Figure 7B:
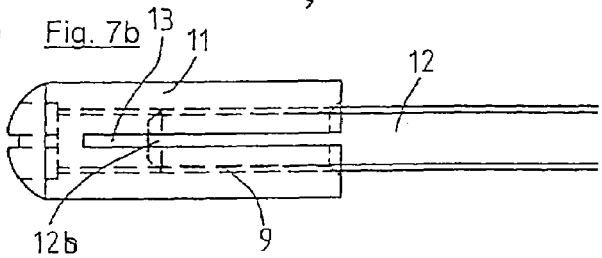
FIG. 7*b* shows a further view of the trigger from FIG. 7*a* in another position of the trigger relative to the transmission element.
Figure 8A:
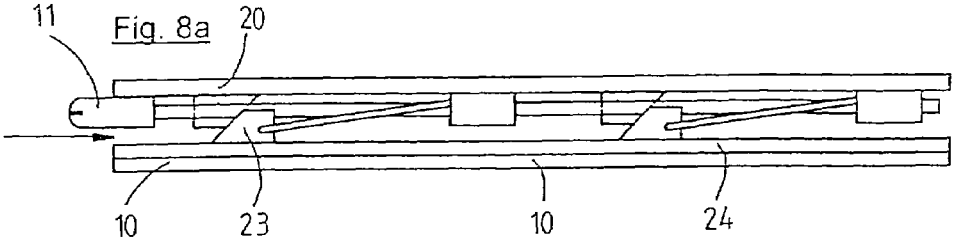
FIG. 8*a* shows a schematically simplified view of a door seal device with trigger according to the invention.

First of all, reference will be made to FIG. 1*a* and, by using this; a first exemplary embodiment of the present invention will be explained in more detail. FIG. 1*a* shows, in two views, a trigger 11 according to one possible variant of the invention, this being a trigger such as is generally used on the hinge side of a door leaf. The trigger 11 therefore has a rounded dome 11*a* which, when the door is closed, strikes the door frame. In order to make the trigger 11 capable of radial expansion, as can be seen from the front-end view, two slots 13 extending in the longitudinal direction are provided, extending in the wall of the trigger, which is substantially cylindrical apart from the dome 11*a*. The trigger according to FIG. 1*a* has a cylindrical central bore 9 which is formed with an internal thread, as can be seen on the right in the side view in FIG. 1*a*. This bore 10 accommodates a threaded rod 12, as can be seen in FIGS. 7*a* and 7*b*. This threaded rod 12 with external thread 12*a* serves as a transmission element in the sense of the present invention, which is part of a triggering mechanism in order to convert the displacement of the trigger 11 when the door is closed into a lowering movement of a seal profile 10, as illustrated in FIGS. 8*a* and 8*b*.

This lowering mechanism will be explained in more detail below with reference to FIGS. 8*a* and 8*b*. The door seal device and the lowering mechanism are illustrated in a highly schematically simplified form in FIGS. 8*a* and 8*b*. It is possible to see the trigger 11, which projects from the housing 20 of the door seal device at the end. Via the transmission element 12 which, for example, is a threaded rod according to the illustration of FIGS. 7*a* and 7*b*, an axial displacement of the trigger 11, that is to say a displacement in the longitudinal direction of the housing 20 (see arrow) when the door is closed, is converted into a lowering movement of the seal profile 10. Various mechanisms are available for this purpose, and are in principle known from the prior art. FIGS. 8*a*, 8*b* show, by way of example, a mechanism which operates with bevels 21 which are located on one side on one or more components 22 seated on the transmission element 12 and on the other side on a component 23 with a corresponding bevel which is then in turn connected to a rail 24 which holds the lowering seal profile 10. If, when the door is closed, a thrust force on the trigger 11 occurs in the direction of the arrow, then said trigger 11 together with the rod-like transmission element 12 is moved in the longitudinal direction into the housing 20 of the door seal and the component 23 having the bevel 21 is pressed down, which has the effect that the rail 24 with the seal profile 10 is lowered. Then, when the seal profile 10 strikes the floor, a force is produced as a result of the floor contact pressure and, when a certain reference value of this floor contact pressure is exceeded, this leads to the desired self-adjustment of the trigger.

Figure 8B:
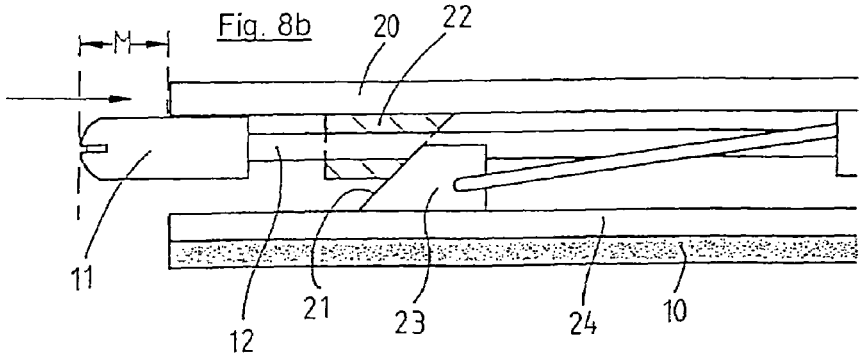
FIG. 8*b* shows an enlarged detail view of the door seal device from FIG. 8*a* in the region of the trigger.

This self-adjustment of the trigger 11 is easily comprehensible by using FIGS. 7*a* and 7*b* in conjunction with FIG. 8*b*. The rod-like transmission element 12 has an external thread 12*a*, which engages in the thread in the bore 9 of the trigger. If the dimension M of the projection of the trigger (see FIG. 8*b*) is too great and the floor contact pressure exceeds the reference value, then the trigger 11 provided with the slots 13 expands and the threaded rod 12 jumps over one or more threads of the internal thread in the bore 9, so that the threaded rod 12 is pushed further into the bore, as can be seen by comparing FIGS. 7*a* and 7*b*. This therefore results in a displacement of the trigger 11 in the longitudinal direction, since the position of the transmission element (threaded rod 12) is defined, so that the dimension M of the projection of the trigger 11 with respect to the housing 20 is reduced. This leads to an adjustment of the trigger position, since the trigger 11 is displaced with respect to the transmission element 12 until the reference value of the floor pressure of the seal profile 10 has decreased to a desired value.

Figure 1B:
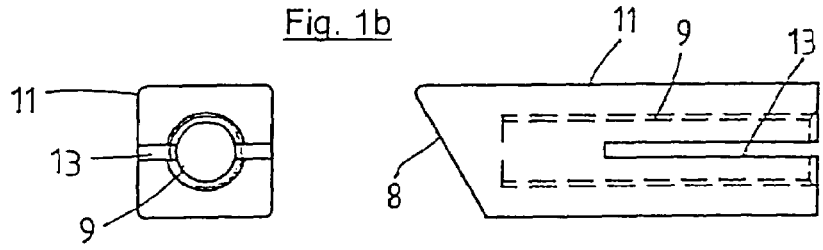
FIG. 1*b* shows a further view of a trigger, which is used on the lock side, in side view and front view.

Further exemplary embodiments of the invention will be explained in more detail below with reference to FIGS. 1*b* to 6. FIG. 1*b* shows a similar exemplary embodiment of a trigger 11 but which has a different form to that of the trigger, which is illustrated in FIG. 1*a*. The trigger 11 according to FIG. 1*b* is firstly angular, as can be seen from the front-end view. In addition, the trigger does not have a dome but a bevel 8 on its side projecting with respect to the door leaf (not shown). This bevel is present since this is a trigger on the lock side. On the lock side, the door leaf gradually encounters the door frame during the closing operation, for which reason the bevel 8 is provided. Triggers of the type illustrated in FIG. 1*b* are angular and are generally accommodated by a groove, a retaining rail or the like belonging to the housing of the door seal device. In principle, the trigger 11 is otherwise constructed in a manner similar to that of FIG. 1*a*. It is possible to see the two lateral slots 13, which are open toward one side, so that the trigger can expand somewhat when, as was explained previously using FIGS. 8*a* and 8*b*, the floor contact pressure of the seal exceeds a reference value. The trigger 11 according to FIG. 1*b* also has a bore 9 with internal thread, which accommodates a rod-like transmission element with external thread, similar to the threaded rod 12 in FIGS. 7*a* and 7*b*. The function of the trigger 11 of FIG. 1*b* during the self-adjustment is thus such that, when the reference value of the floor contact pressure is exceeded, the threaded rod 12 is pushed further into the bore 9 of the trigger.

Figure 2:
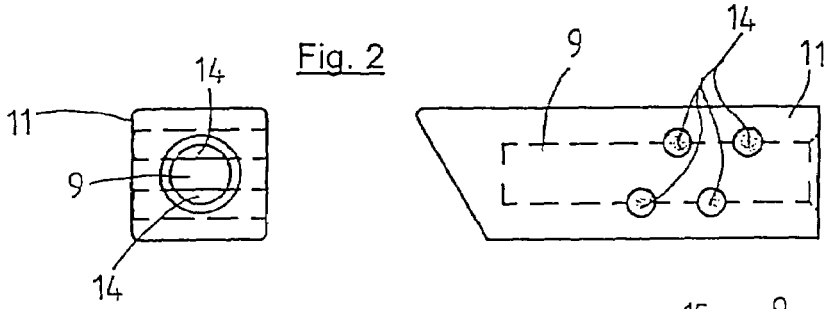
FIG. 2 shows a further schematically simplified illustration of a trigger in side view and front view according to an alternative variant of the invention.

FIG. 2 shows a somewhat different exemplary embodiment, in which, although the trigger 11 has a bore 9, it has no internal thread but a plurality of elastic elements 14 running transversely with respect to the bore 9, for example, in an axially mutually offset arrangement. As can be seen from FIG. 2, on the left and on the right, in each case these elastic elements 14 are alternately arranged at the top and bottom in the bore and in each case are always offset in the axial direction in relation to one another, running transversely with respect to the axial direction of the bore 9 and projecting tangentially into this bore in the manner of sectors (see the left-hand illustration of FIG. 2). In the case of the trigger of FIG. 11, too, the bore 9 again accommodates a rod-like transmission element 12 (not shown in FIG. 2), which can also have an external thread, in a similar way to the threaded rod 12 in FIG. 7*a*. As a result of the elastic elements 14 and their specific arrangement, a type of thread is provided, the elastic elements 14 achieving a frictional force on the circumference of a threaded rod 12, so that, in the variant according to FIG. 2, when a thrust force which exceeds a specific threshold value occurs in the longitudinal direction of the transmission element 12, the latter is pushed further into the bore 9, so that self-adjustment of the trigger also occurs here.

Figure 3:
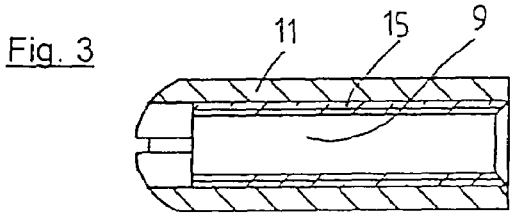
FIG. 3 shows a longitudinal section through a trigger according to a further alternative variant of the invention.

In the following text, with reference to FIG. 3, a further possible variant of such a trigger will be described. Here, the trigger 11 has a rubber thread 15 in the bore 9. For instance, the trigger 11 is a hard/soft injection molded part. When such a rubber thread 15 is used, the same effect can be achieved as described previously in the case of FIG. 1*a*, it not being absolutely necessary in the variant according to FIG. 3 to provide the trigger 11 with slots 13, since the rubber thread 15 permits a threaded rod 12 to slip further in the bore 9 of the trigger (jumping over threads), without the trigger 11 expanding in the radial direction, when a thrust force occurs in the longitudinal direction, if said force exceeds a certain threshold value.

Figure 4A:
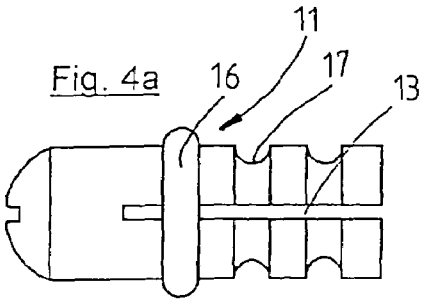
FIG. 4*a* shows a view of a trigger according to a further alternative variant of the invention in a first position of the holding means.
Figure 4B:
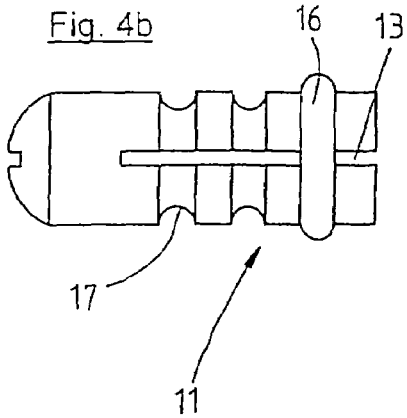
FIG. 4*b* shows a corresponding view of the trigger from FIG. 4*a* but in another position of the holding means.
Figure 4C:
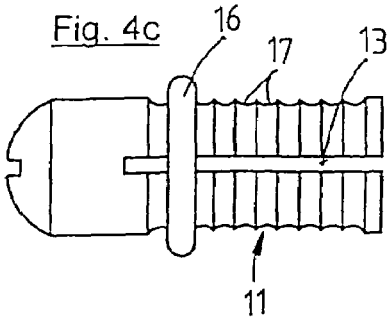
FIG. 4*c* shows a further alternative variant of a similar trigger to that in the exemplary embodiment described previously according to FIGS. 4*a* and 4*b;*

In the following text, with reference to FIGS. 4*a* to 4*c*, a further exemplary embodiment of the invention will be described in more detail. The Figures show triggers 11 in each case provided for the hinge side, which are provided with slots 13 running in the longitudinal direction, in a similar way to that in the exemplary embodiment according to FIG. 1*a*. However, the radial expansion of the triggers 11 illustrated in FIG. 4*a* to FIG. 4*c* is variable because a holding means is provided, for example in the form of a rubber ring 16, which can be pushed onto the circumference of the trigger 11, as illustrated in FIG. 4*a*. For this purpose, on the circumference of the trigger there are a plurality of grooves 17 which are spaced apart from one another in the longitudinal direction and which accommodate the rubber ring 16. Then, if the rubber ring is pushed further rearward from an arrangement further forward according to FIG. 4*a*, so that it is accommodated by one of the other grooves 17, as illustrated in FIG. 4*b*, in the variant of FIG. 4*b* the trigger is held together by the rubber ring 16 more strongly at the circumference against expansion than in the variant according to FIG. 4*a*. Consequently, the trigger illustrated in FIG. 4*a* can be expanded radially by a threaded rod or the like accommodated in its bore, even with a lower thrust force. This means that, in the variant according to FIG. 4*a*, even with relatively low reference values of the floor contact pressure of the seal profile 10, the trigger 11 is expanded outward and, as a result, a relative displacement of trigger 11 with respect to transmission element 12 is achieved. In the variant according to FIG. 4*b*, a higher thrust force has to be applied in order to achieve the same effect, since the trigger 11 is held together more strongly by the rubber ring 16. The self-adjustment can be configured variably by means of the different positions of the rubber ring 16 in the grooves 17 on the circumference of the trigger 11. FIG. 4*c* shows a further exemplary embodiment in which, however, the rubber ring 16 is narrower and there is a larger number of grooves 17, so that the result is a type of fluting on the external circumference of the trigger 11. As a result, more displacement positions of the rubber ring 16 are possible, which permit finer tuning. Instead of the rubber ring 16, for example a spring ring can also be used.

Figure 5A:
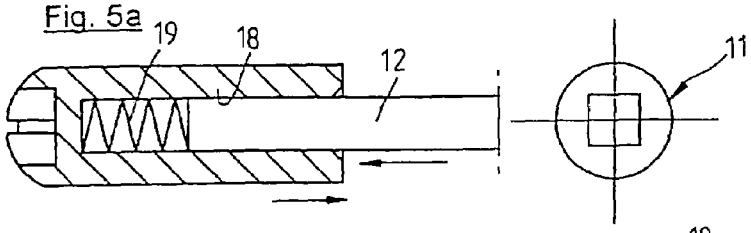
FIG. 5*a* shows a longitudinal sectional illustration of a trigger and a front view of the trigger according to a further alternative variant of the invention.

In the following text, with reference to FIG. 5*a*, a further exemplary embodiment of the invention will be described in more detail. Again illustrated is a trigger 11, which is suitable in particular for the hinge side of a door leaf. The basic shape is similar to that in the case of the trigger according to the exemplary embodiment according to FIG. 1*a*. However, the transmission element 12 used here is a rod without an external thread, which is accommodated in a simple bore 18 without internal thread in the trigger 11. Arranged in the bore 18, at the end in front of the transmission element 12, is a deformation element 19, for example a folded sheet metal part consisting of a material, which is deformed when a thrust force acts through the transmission element 12. Such a thrust force occurs when the seal profile 10 is subjected to a floor contact pressure as the door seal device is lowered, said pressure being transmitted to the trigger via the components 24, 23, 22, 12 (see also FIG. 8*b*). The trigger 11 according to FIG. 5*a* is then pushed further onto the rod-like transmission element 12, as a result of which the deformation element 19 is compressed and deformed by end compression. The deformation element 19 is deformed to an extent, which corresponds to the floor contact pressure of the seal profile. No reverse deformation occurs in this case, so that after the self-adjustment the deformation element 19 and therefore also the rod-like transmission element 12 remains in the adjusted position then achieved.

Figure 5B:
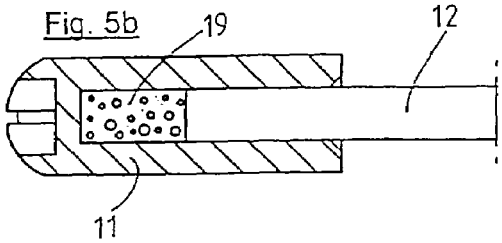
FIG. 5*b* shows a longitudinal section through a trigger according to a further alternative variant of the invention.

FIG. 5*b* shows a similar design variant of the trigger 11, in which likewise a rod-like transmission element 12 without external thread engages in a simple hole in the trigger 11. The deformation element 19 is constructed differently here, however, and consists of a hard foam, which, during the self-adjustment, is pressed in by the end of the transmission element 12 and subsequently remains in the deformed, compressed form.

Figure 6:
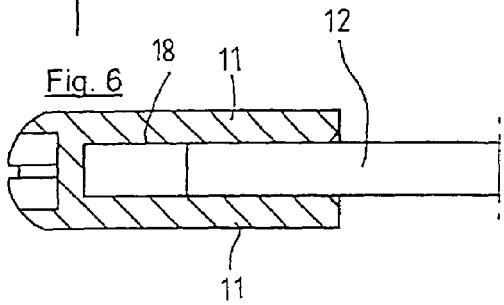
FIG. 6 shows a longitudinal section through a trigger according to a further alternative variant of the invention.

FIG. 6 shows a further possible exemplary embodiment, in which the trigger 11 according to the invention is designed in a similar way to that in the two previously described variants according to FIGS. 5*a* and 5*b*. Here, too, a bore 18 without internal thread is provided and the transmission element 12 used is a simple rod. This rod 12 is introduced with a press fit into the bore 18 of the trigger. By means of this press fit, a similar effect is achieved to that when the transmission element 12 is displaced against a deformation element 19. The press fit of the transmission element 12 in the bore 18 according to FIG. 6 is chosen to be so firm that, up to a reference value of the floor contact pressure of the seal profile and an associated thrust force, which acts in the direction of the arrow, initially no displacement of the transmission element 12 occurs. However, when the envisaged reference value of the thrust force is exceeded, the transmission element 12 is pushed further into the bore 18, the opposing force rising as a result of the press fit the further the rod is pushed into the bore. As a result, self-adjustment of the trigger 11 is likewise possible.

Figure 9:
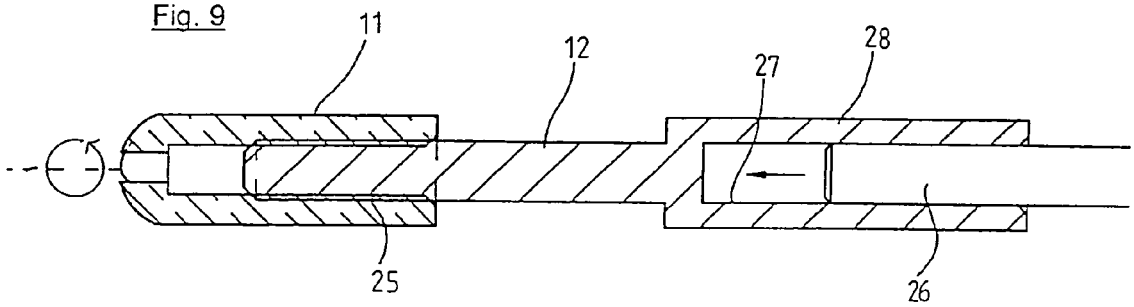
FIG. 9 shows a further enlarged sectional view of a trigger according to an alternative variant of the invention.

In the following text, reference will be made to FIG. 9 and, by using the latter, a further exemplary embodiment of the invention will be explained in more detail. The exemplary embodiment according to FIG. 9 shows a trigger 11 and a rod-like transmission element 12, which is provided on the front side with a thread 25. This thread 25 is screwed into a threaded bore of the trigger 11. In the exemplary embodiment according to FIG. 9, in a similar way to that in the exemplary embodiment according to FIG. 6, a further transmission element 26 in the form of a rod is provided, which is accommodated with a press fit in a bore 27 of a hollow cylindrical section 28. This hollow cylindrical section 28 is connected to the rod 12 at the end facing away from the thread 25. Thus, here the transmission of force takes place from the trigger 11 via the rod-like transmission element 12 with the hollow cylindrical section 28 to the further rod-like transmission element 26. The connection between the rod 26 and the hollow cylindrical section 28 comprises a press fit, so that when a thrust force occurs in the axial direction, caused by an increased floor contact pressure of the seal profile (not shown here), in a manner similar to that in the exemplary embodiment described previously by using FIG. 6, a displacement of the rod 26 in the bore 27 in the direction of the arrow takes place, by means of which the extent of the projection of the trigger 11 with respect to the door leaf is reduced.

In a manner differing from that in the variant according to FIG. 6, in the exemplary embodiment according to FIG. 9 fine adjustment is also provided. The thread 25 is a conventional thread and thus not one in which a thread jump is provided. In the event of a thrust force, only a displacement of the rod 26 in the hollow cylindrical section 28 therefore occurs but not a displacement between the section with thread 25 and the trigger 11. For fine adjustment, however, it is possible to rotate the trigger 11 and therefore, independently of the self-adjustment, also to perform a fine adjustment in which the extent of the projection of the trigger 11 is regulated within closer ranges.

Figure 11:
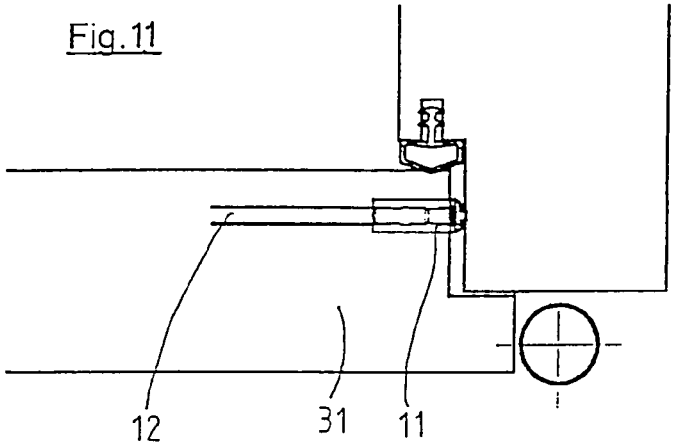
FIG. 11 shows a corresponding view to that in FIG. 10 but with the door closed.
Figure 12:
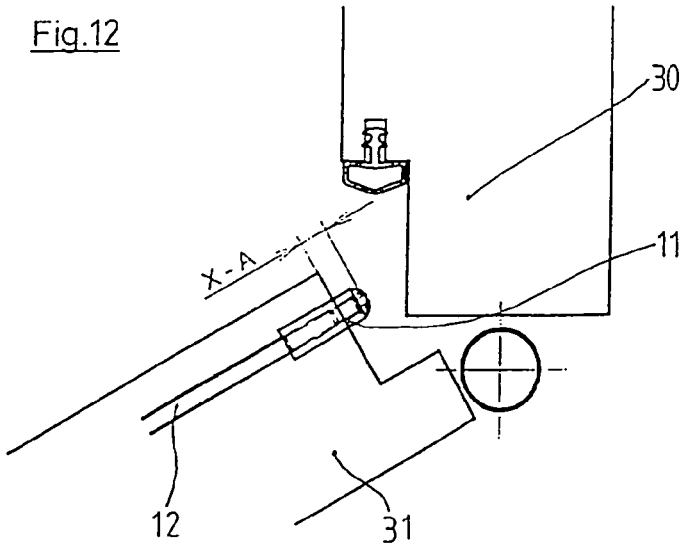
FIG. 12 shows a corresponding view to that in FIG. 10 but with the door opened again following the self-adjustment.

The method according to the invention for installing and adjusting the door seal device will be explained once more in the following text with reference to FIGS. 10 to 12.

Figure 10:
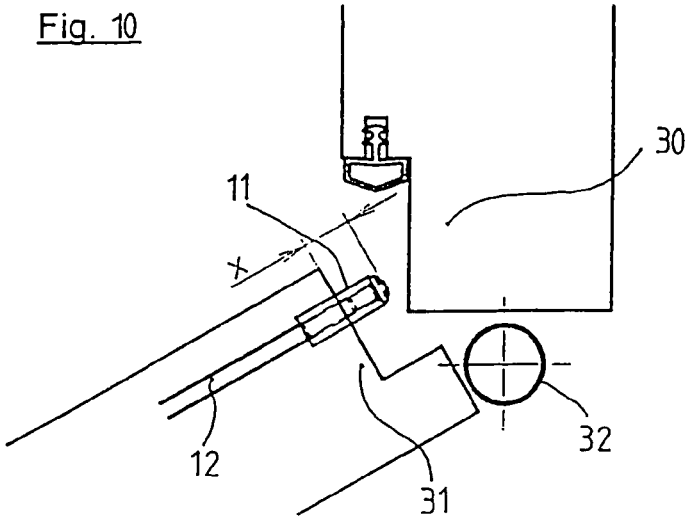
FIG. 10 shows a schematically simplified plan view of an extract in the region of the triggering device on the hinge side of a door, with the door open before the self-adjustment.

FIG. 10 shows, in a schematically simplified plan view, an extract in the region of a door frame 30 with a door leaf 31 on the hinge side. The hinge 32 is illustrated schematically. It is possible to see on the door leaf the trigger 11 projecting by an extent "X", the door leaf 31 being illustrated here in a partly opened position, to be specific following the installation of the door seal device, before the door leaf 31 has been moved into the closed position for the first time. The extent X illustrated of the projection of the trigger 11 is therefore the extent of the projection provided by the manufacturer. The door is then closed by the fitter, so that the position illustrated in FIG. 11 results, in which the trigger 11 is acted on in the rabbet of the door frame 30 and, as a result, causes the lowering of a seal profile, which is not illustrated in FIG. 11. However, the displacement travel of the trigger 11 can be seen by comparing FIG. 11 with FIG. 10. During this first-time closure of the door leaf 31, the self-adjustment of the trigger 11 according to the invention takes place. Then, if the door leaf 31 is again moved from the position illustrated in FIG. 11 into the open position, which is illustrated in FIG. 12, then, although the trigger 11 completes a return displacement movement, because of the self-adjustment which has previously been carried out, the result of said movement is a lower extent of the projection of the trigger. Following this self-adjustment, the extent of the projection is "X-A", as illustrated in the drawing of FIG. 12, which results from the original extent "X" of projection according to FIG. 10 minus the displacement of the trigger 11 by the dimension "A" with respect to the rod-like transmission element 12 which has occurred on account of the self-adjustment. If the door leaf 31 is then closed again and then opened again, the extent of the projection "X-A" remains permanently, unless the constructional conditions change, for example in that the door leaf sinks at some time following installation. In this case, automatic readjustment of the trigger 11 would occur.

LIST OF DESIGNATIONS

8 Bevel
9 Bore
10 Seal profile
11 Trigger
11*a* Dome
12 Threaded rod/transmission element
12*a* External thread
13 Slots
14 Elastic elements
15 Rubber thread
16 Rubber ring
17 Groove
18 Bore
19 Deformation element
20 Housing
21 Bevels
22, 23 Components
24 Rail
25 Thread
26 Transmission element
27 Bore
28 Hollow cylindrical section
30 Door frame
31 Door leaf
32 Hinge

What is claimed is:

1. A door seal device comprising, at least one trigger a transmission element extending from the at least one trigger a seal profile lowered by axial displacement of the at least one trigger, creating door seal pressure, wherein axial displacement of the at least one trigger with respect to the transmission element connected thereto occurs when the door seal pressure exceeds a preset amount, wherein the axial displacement leads to self-adjustment of the trigger and the trigger remains in the adjusted position.

2. The door seal device as claimed in claim 1, wherein the transmission element connected to the at least one trigger comprises a threaded rod and the trigger moves over at least one thread during the self-adjustment.

3. The door seal device as claimed in claim 2, wherein the at least one trigger is provided with means for radial expansion and elastic reverse deformation.

4. The door seal device as claimed in claim 3, wherein the means for the radial expansion of the at least one trigger comprise at least one slot, in a wall of the trigger.

5. The door seal device as claimed in claim 1, wherein the at least one trigger accommodates a plurality of elastic elements in a bore that accommodates the transmission element.

6. The door seal device as claimed in claim 1, wherein the at least one trigger has a rubber thread in a bore.

7. The door seal device as claimed in claim 1, wherein the at least one trigger has at least one slot extending in the longitudinal direction and holding means which can be displaced in an axial position and during the displacement of which can vary the ability of the trigger to expand radially.

8. The door seal device as claimed in claim 7, wherein the holding means is a ring.

9. The door seal device as claimed in claim 7, wherein the holding means is a rubber ring or spring ring.

10. The door seal device as claimed in claim 7, wherein the at least one trigger has on its circumference grooves or profiling or fluting, which define an axial displacement position of the holding means.

11. The door seal device as claimed in claim 1, wherein the transmission element fits within a bore of the at least one trigger and can be displaced against a deformation element in the bore if the preset amount of door seal pressure is exceeded.

12. The door seal device as claimed in claim 11, wherein the axial extent of the deformation element in the bore can be reduced in the event of a compressive force, but no reverse deformation occurring.

13. The door seal device as claimed in claim 11, wherein the deformation element is a folded metal sheet.

14. The door seal device as claimed in claim 11, wherein the deformation element comprises a hard foam.

15. The door seal device as claimed in claim 1, wherein the transmission element is accommodated in a bore of the at least one trigger with a press fit so that, when the transmission element is pushed deeper into the bore, the proportion of the area in the press fit and the opposing pressure increase.

16. The door seal device as claimed in claim 1, wherein multiple self-adjustment is provided in the region of the at least one trigger and/or further parts of the triggering mechanism located in the interior of the housing.

17. The door seal device as claimed in claim 1, wherein, in addition to the self-adjustment, manually adjustable fine adjustment of the at least one trigger is provided, by means of the ability of the trigger to rotate on a transmission element provided with a thread.

18. The door seal device of claim 1, further comprising a first component having a bevel attached to the transmission element, a second component having a bevel contacting the bevel of the first component, the second component contacting the seal profile, wherein horizontal movement of the trigger causes vertical movement of the seal profile.

19. A door having a front, a back and two sides, at least one trigger extending from one of the sides a transmission element extending from the at least one trigger a seal profile lowered by axial displacement of the at least one trigger, creating door seal pressure, wherein axial displacement of the at least one trigger with respect to the transmission element connected thereto occurs when the door seal pressure exceeds a preset amount, wherein the axial displacement leads to self-adjustment of the trigger and the trigger remains in the adjusted position even when the door is opened.

20. The door seal device of claim 19, further comprising a first component having a bevel attached to the transmission element, a second component having a bevel contacting the bevel of the first component, the second component contacting the seal profile, wherein horizontal movement of the trigger causes vertical movement of the seal profile.

* * * * *